US005423136A

United States Patent [19]

Gulli

[11] Patent Number: 5,423,136

[45] Date of Patent: Jun. 13, 1995

[54] SEGMENTED BOUNCING ATTACHMENT FOR SHOES

[76] Inventor: Frank Gulli, 62 Livingston Ave., Dobbs Ferry, N.Y. 10552

[21] Appl. No.: 109,729

[22] Filed: Aug. 20, 1993

[51] Int. Cl.[6] ..... A43B 5/00; A43B 3/10

[52] U.S. Cl. ..... 36/132; 36/7.8; 36/29; 482/77; 482/111

[58] Field of Search ..... 36/1, 7.8, 29, 132, 36/136; 482/77, 111

[56] References Cited

U.S. PATENT DOCUMENTS

| | | | |
|---|---|---|---|
| 2,430,466 | 11/1947 | Hedmond | 36/7.8 |
| 2,756,517 | 7/1956 | Youtz | 36/7.8 |
| 4,227,320 | 10/1980 | Borgeas | 36/88 |
| 4,676,009 | 6/1993 | Davis | 36/7.8 |
| 4,774,776 | 10/1988 | Gulli | 36/132 |
| 5,222,312 | 6/1993 | Doyle | 36/28 |
| 5,224,278 | 7/1993 | Jeon | 36/29 |

*Primary Examiner*—Paul T. Sewell
*Assistant Examiner*—Marie Denise Patterson
*Attorney, Agent, or Firm*—Martin J. Spellman, Jr.

[57] ABSTRACT

An attachment for the soles of shoes to provide a cushioned bouncing effect. The attachment has wall rising on each side of base which the user's shoe rests and securing straps attached to the sides to secure the device to user's foot. The top surface of the base is slightly ribbed to provide both a gripping and cushioning for the user's foot. The lower section of the body of the device has inflatable chambers along the sides and across the front and rear ends. Egg carton shaped recesses of generally cubic shape and with solid vertical walls are provided to provide strength and rigidity to prevent a distortion of the lower surface when the chambers are inflated.

1 Claim, 5 Drawing Sheets

SEGMENTED BOUNCING ATTACHMENT FOR SHOES

BACKGROUND OF THE INVENTION

1. Field of the Invention

This invention is concerned with attachments for shoes which provides an air cushion for the foot to provide desirable increased reaction force in use either for simple walking exercises or running. It may be used for long distance runners, joggers in order to reduce the shocks to their skeleton systems from the constant pack built to which they are subjected. Reactive force supplied to the user facilitates and makes it easier to cover distances and decreases the time necessary to walk or run a certain distance. The device of the present invention is an improvement over the prior device disclosed in my prior patent U.S. Pat. No. 4,774,776 issued Oct. 4, 1988.

2. Prior Art

The device of my prior patent has spherical surface and in the case of plain inflation the lower surface tended to balloon out beyond the point that allowed the user to maintain comfortable balance and at the same time a higher inflation pressure to increase the cushion effect. In addition, to my prior patent, the device is related air cushioned running attachment for shoes.

Of background interest are shown in U.S. Pat. No. 5,222,312, Doyle which shows an inflatable shoe sole with annular expanding air pockets each fed by and supplied with air. The plurality of tubes connecting the air cells to the pump assembly at the rear of the shoe. In this case, there is a built in self-contained pneumatic inflation device.

U.S. Pat. No. 4,676,009, Davis discloses an inflatable shoe wherein the inflation area is a hollow pneumatic circular tube provided with protective bottom. In this case, the device is currently used more for entertainment since the air inflation is only about a peripheral ring and would certainly be awkward to walk, certainly would be awkward to walk or run with. It is primarily designed for a child for play purposes.

U.S. Pat. No. 5,224,278, Jeon discloses a mid sole having pillows shock absorbing air bag at the heel section.

U.S. Pat. No. 2,756,517, Youtz discloses a band attachment for shoes comprising an endless tube elastic material with parallel straight sections.

U.S. Pat. No. 2,430,466, Edmond discloses a air boot that is generally round.

U.S. Pat. No. 4,227,320, Borgeas discloses a cushion sole to be placed in shoes in order to provide comfort for the foot. This is served primarily as a shock absorber.

SUMMARY OF THE INVENTION

In accordance with the present invention, is provided improved bouncing shoe, bouncing attachment for shoes and feet, it is more stable and secure for its intended use than in the device shown in my prior patent U.S. Pat. No. 4,774,776.

The device of the present invention includes a rubber molded body which is formed integrally throughout except for the attachment of wrap means for securing the device to the users shoe or foot.

The device comprises a base upon which the shoe rests which is generally has parallel sides extending the approximate length of a user's foot with both the front and the rear ends of a generally rounded configuration connecting the sides. The top surface is provided with parallel scalped ridges providing a gripping surface and cushioning for the user's foot ending up from each side edge are side walls approximately the height of the user's foot or shoe into which securing straps are attached at the top edges thereof. The lower section of the body comprises inflatable chambers along each side and across the ends, the lower surfaces comprises at the rear section a partially ribbed surface for traction and then the front are tow and inclined surface with transfers traction ribs. Essential section is provided with a carton recess of generally cubic shaped with vertical walls, they are defined by solid vertical walls. In the preferred form four recesses of approximately 1"×1"×1" are formed into rectangular shape and one additional recess is centrally located at the front end rear of these recesses. The walls between the recesses give sufficient strength and rigidity to maintain the lower surface of the device and yet allows the other chambers of the device to be inflated to provide the desired balance and reactive force to provide shock absorbing qualities for the user as well as to create the upward force when the foot is lifted giving the springiness to the step for exercise, running or racing. The device is provided with an inflatable valve for insertion of an inflation needle at any convenient location preferably the rear wall. All the air chambers are in direct communication with each other and comprise a forward and a rearward chamber with air chambers going along the full length of each side of the device.

In use, the device is inflated to the desired amount of the device placed upon the user. It can then run step with the ball of the foot being substantially cushioned by the inflated properties of the device and the impression and rebounding providing additional force to aid in running or walking. The air pressure is adjusted to the appropriate amount desired by the user by inserting a needle filling into the rubber valve.

BRIEF DESCRIPTION OF THE DRAWING

In the accompanying drawing which forms a part of this specification.

ILLUSTRATIVE SPECIFIC EMBODIMENT

Figure 1:
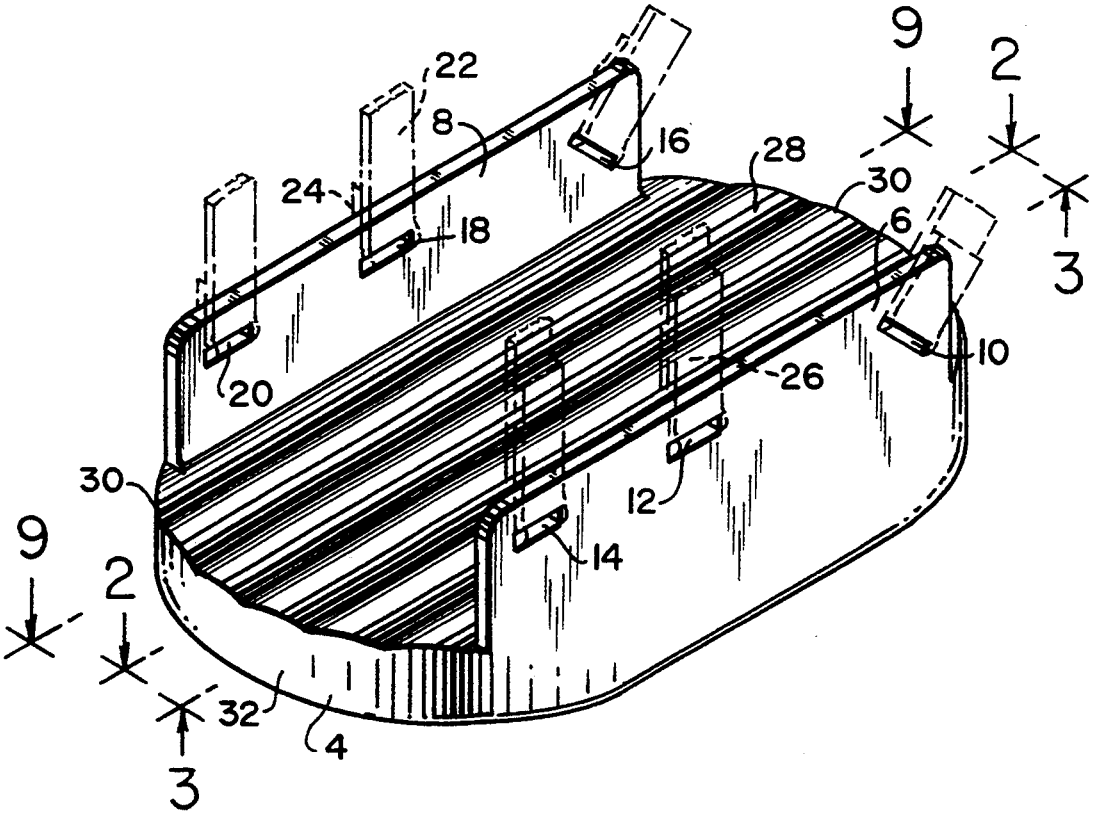
FIG. 1 is perspective view of the bouncing attachment of the present invention.
Figure 2:
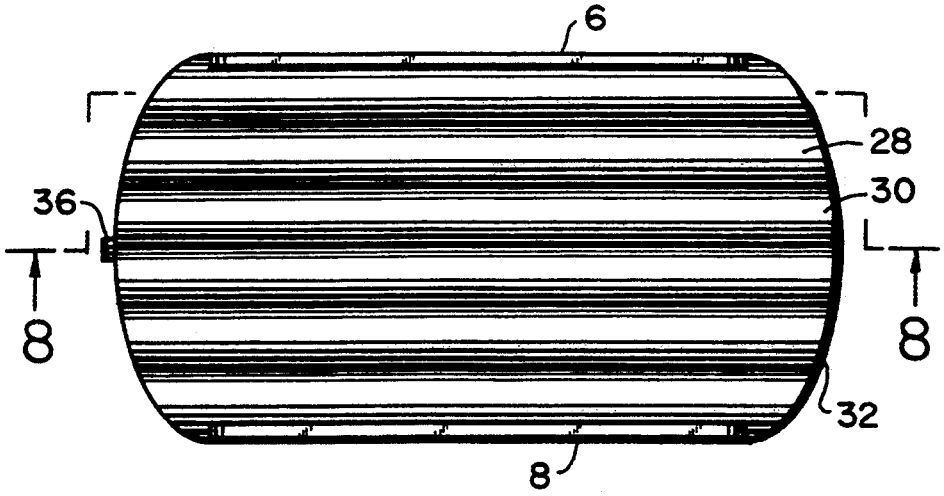
FIG. 2 is a top plan view along lines 2—2 of FIG. 1.
Figure 3:
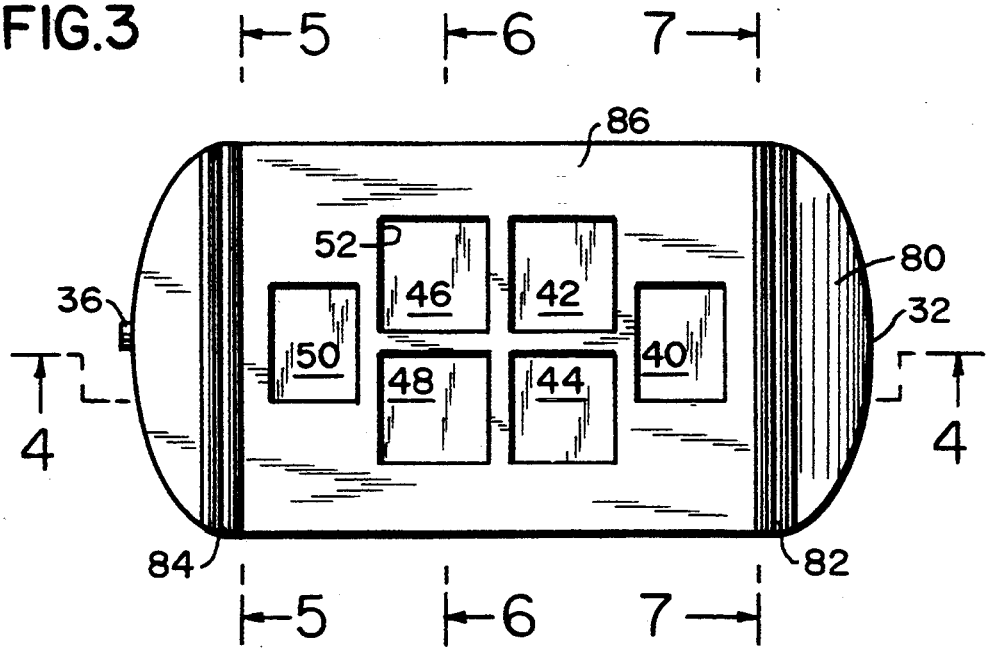
FIG. 3 is a bottom plan view of the device.
Figure 4:
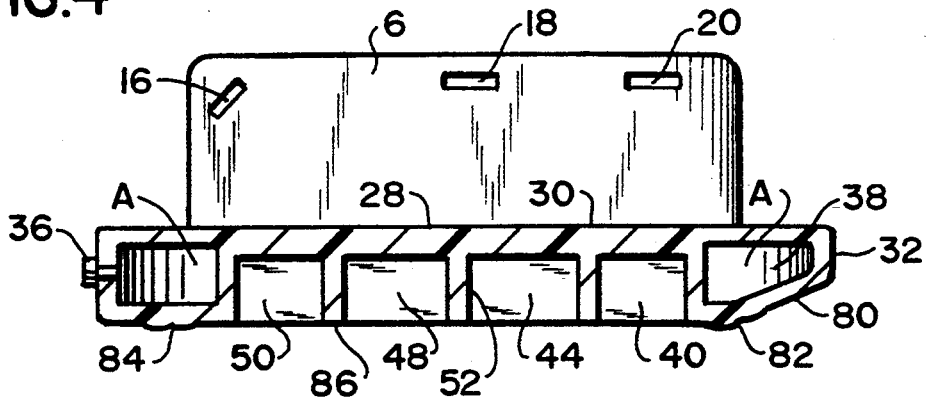
FIG. 4 is a sectional view taken along lines 4—4 of FIG. 3.
Figure 5:
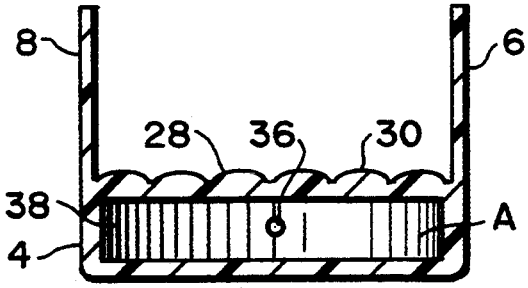
FIG. 5 is a sectional view along lines 5—5 of FIG. 3.
Figure 6:
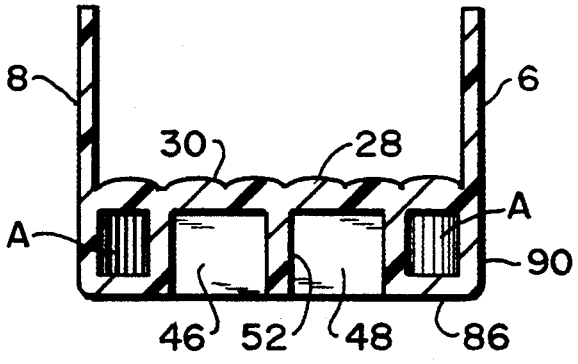
FIG. 6 is a sectional view along lines 6—6 of FIG. 3.
Figure 7:
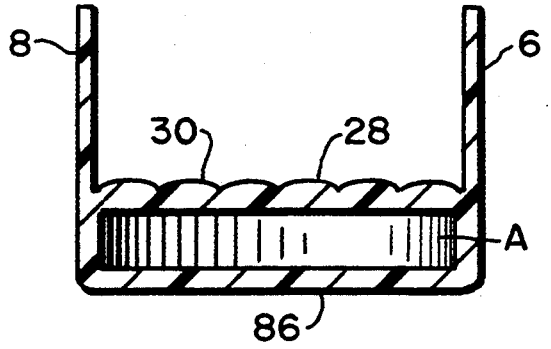
FIG. 7 is a sectional view taken along lines 7—7 of FIG. 3.
Figure 8:
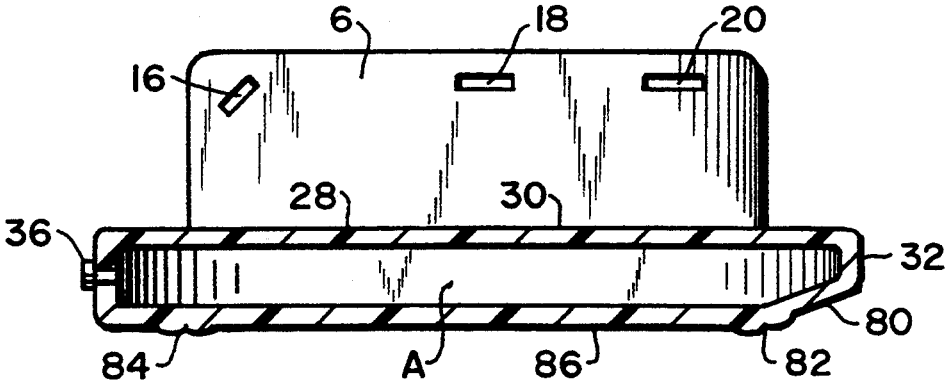
FIG. 8 is a sectional view taken along lines 8—8 of FIG. 2.
Figure 10:
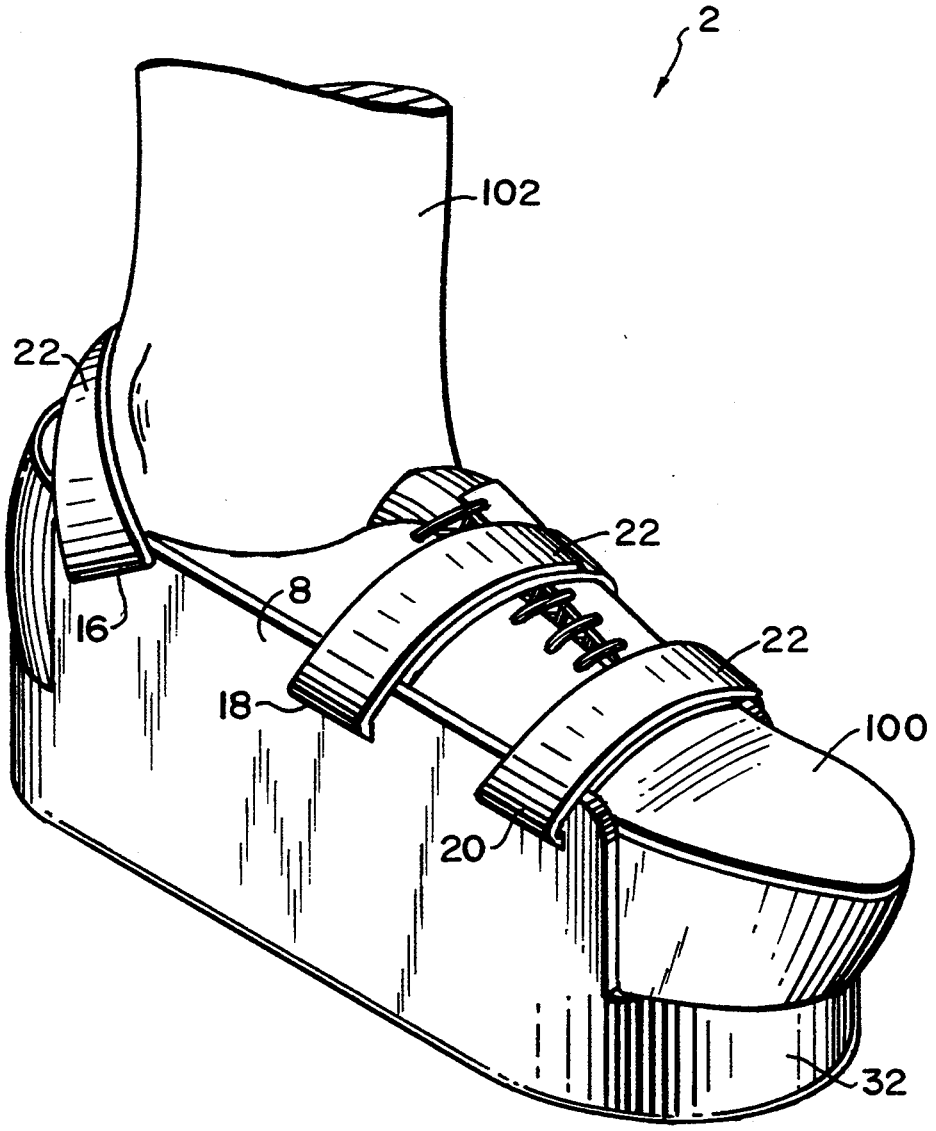
FIG. 10 is a perspective view of the device in place on the shoe of the wearer.

Referring to the accompanying drawing, the place is shown in general in FIG. 10 is indicated in general with the numeral 2. The body 4 of the device 2 is constructed entirely of molded rubber or equivalent plastic compositions resilient properties and which is impervious to the passage of air. The body 4 has a left upperwardly extending sidewall 6 and a right sidewall 8 each of sufficient height to encompass the sides of the wearer's shoe. The upper portions of the sides 6 and 8 are provided with slots 10 and 16 at approximately 45 angles at the rear thereof, and parallel slots 12, 14, 18 and 20 in the middle and forward portions of the sides 6 and 8 to receive retaining straps 22 which are secured by stitching permanent retained on one side of the attachment indicated by the straps 22 going through the slots 16, 18, and 20 and the other ends 26 with velcro facings and are secured in known manner. The top surface 28 of the base 4 which contacts the users foot shoe is provided with parallel scallop ridges as indicated 30. The front of the attachment 32 is molded in an arc form and the rear 34 in a similar arc form. A filler port 36 for inserting the filling inflation needle passes through the rear wall 31 to fill the inflatable chamber A which extends along both sides of the attachment and across the front and rear sections of the attachment as shown more clearly in FIGS. 3–8 of the drawing. The contiguous air chamber of the device is further indicated by the letter A in the drawings. The lower surface of the device in the central section is provided with egg carton type of recesses 40, 42, 44, 46, 48 and 50 as shown in FIGS. 3, 4, and 6. They are approximately 1"×1"×1".

The purpose of the foregoing recesses is to assure the stability of the device so that it remains substantially flat across the bottom 86. The walls of ridges 52 between the recesses provide the needed sufficient strength to maintain the shape of the attachment and to prevent any unwanted ballooning of the surfaces. The lower surface of the device at the forward end 32 is inclined upwardly as indicated at 80 and has transverse ridges 82 for traction. Similarly ridges 84 adjacent the rear 31 on the lower surface 86 compresses it to cushion the feet and provide a bounce or spring for the user. The shoe attachment can be inflated to an air pressure which best suits the user in accordance with his weight and the amount of reaction force that he desires as he walks, runs or jumps. The attachment can be hardened by inflating it with air for hard running and jumping and a lot of bounce or can be softened by letting out air for slower activities such as walking.

Figure 9:
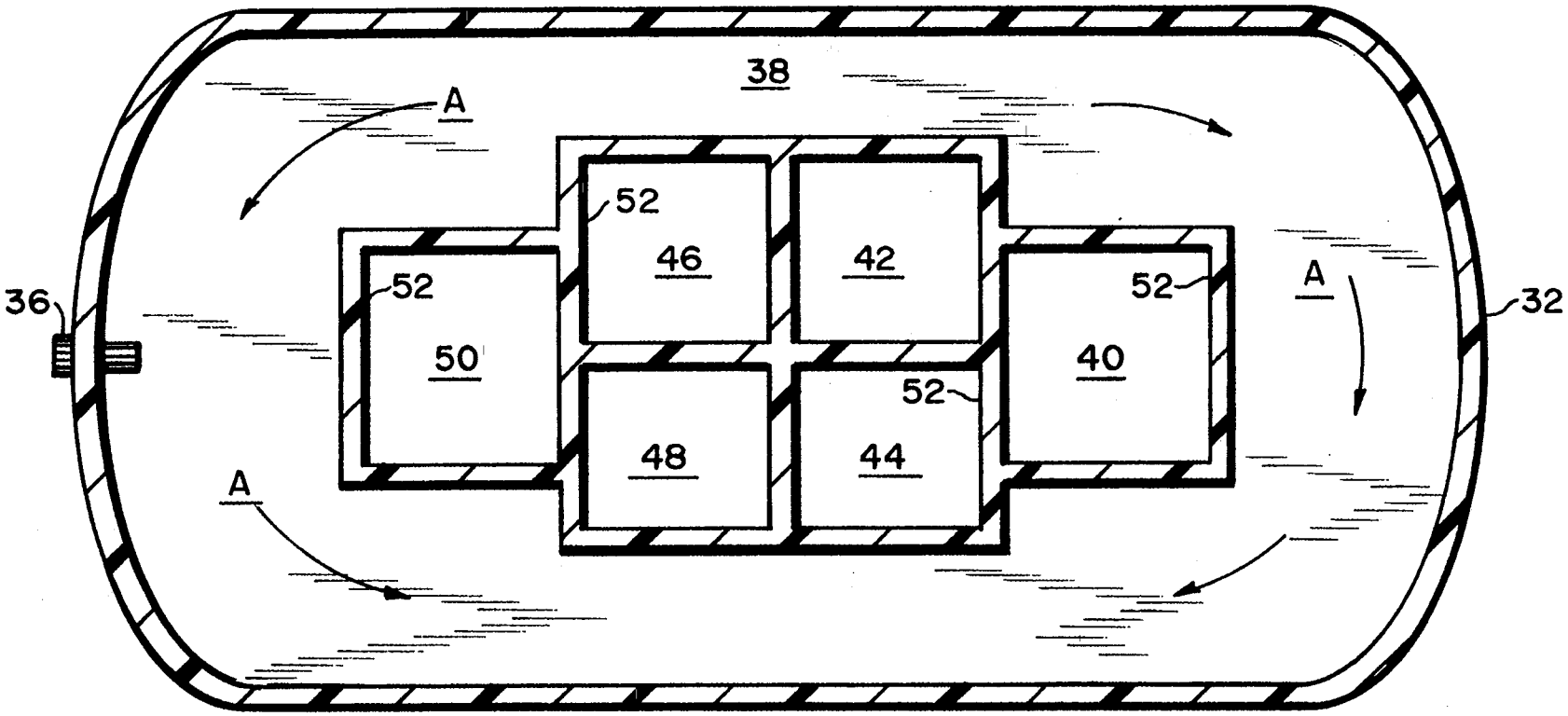
FIG. 9 is a sectional view taken along line 9—9 of FIG. 1.

In use, this device is strapped on as shown in FIG. 9 over the shoe 100 of the users foot 102.

What is claimed is:

1. A bouncing shoe attachment comprising a molded inflatable body comprising a top surface having a longitudinal parallel scalloped ridges, upwardly extending side walls with retaining means for securing the device to the user's foot said side walls extending upwardly above said top surface, an inflatable air chamber running contiguously along each side of the body and across the front and rear ends of the attachment, a central portion interior of said inflatable air chamber on the lower side of the attachment having (a egg carton) rectangular generally cubic recesses with rigid side walls defining each recess in the central section of the device, said (recess) recesses maintaining the (generally flat) lower surface of the device, generally flat when the device is inflated and access port means for adding and removing air to said (inflation) inflatable air chamber.

* * * * *